US008981667B2

(12) United States Patent
Shao et al.

(10) Patent No.: US 8,981,667 B2
(45) Date of Patent: Mar. 17, 2015

(54) CURRENT CONTROLLING CIRCUIT FOR A LIGHT-EMITTING DIODE DRIVER AND PRODUCING METHOD THEREFOR

(75) Inventors: Bin Shao, Shanghai (CN); Kenji Tomiyoshi, Chiba (JP)

(73) Assignee: Analog Devices Global, Hamilton (BM)

( * ) Notice: Subject to any disclaimer, the term of this patent is extended or adjusted under 35 U.S.C. 154(b) by 420 days.

(21) Appl. No.: 13/548,624

(22) Filed: Jul. 13, 2012

(65) Prior Publication Data

US 2013/0076252 A1 Mar. 28, 2013

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |
| ***G05F 1/46*** | (2006.01) |

(52) U.S. Cl.

CPC ..... *H05B 33/0842* (2013.01); *G05F 1/46* (2013.01); *H05B 33/0824* (2013.01)

USPC ..... 315/291; 315/210

(58) Field of Classification Search

None

See application file for complete search history.

(56) References Cited

U.S. PATENT DOCUMENTS

| | | | | |
|---|---|---|---|---|
| 7,135,841 | B1 * | 11/2006 | Tomiyoshi et al. | 323/224 |
| 8,847,503 | B2 * | 9/2014 | Chang et al. | 315/201 |
| 2006/0226898 | A1 | 10/2006 | Vitunic et al. | 330/9 |
| 2010/0201382 | A1 | 8/2010 | Welland | |

FOREIGN PATENT DOCUMENTS

| | | | |
|---|---|---|---|
| CN | 101739186 | A | 6/2010 |
| CN | 101860204 | A | 10/2010 |

OTHER PUBLICATIONS

"Chinese Application Serial No. 201110253164.1, Office Action mailed May 5, 2014", (w/ English Summary), 7 pgs.

"Chinese Application Serial No. 201110253164.1, Response filed Sep. 21, 2014 to Office Action mailed May 5, 2014", (w/ English Translation of Claims), 11 pgs.

* cited by examiner

*Primary Examiner* — Douglas W Owens

*Assistant Examiner* — Dedei K Hammond

(74) *Attorney, Agent, or Firm* — Schwegman Lundberg & Woessner, P.A.

(57) ABSTRACT

The present disclosure proposes a fully integrated accurate LED output current controlling circuit and method, which can be seamlessly combined with true PWM dimming. The current controlling circuit has an auto zero function in the light-emitting diode driver to eliminate offsets caused by the system, process variations, parasitic effects, dimming and so on in an LED driver application, and thus is capable of controlling the LED current with high accuracy. Moreover, the driver of the present disclosure does not require the use of external components such as an external resistor to regulate current accuracy.

32 Claims, 8 Drawing Sheets

CURRENT CONTROLLING CIRCUIT FOR A LIGHT-EMITTING DIODE DRIVER AND PRODUCING METHOD THEREFOR

CROSS-REFERENCE TO RELATED APPLICATIONS

This application claims priority to Chinese Patent Application No. 201110253164.1, filed on Aug. 31, 2011, which is incorporated herein by reference in its entirety.

TECHNICAL FIELD

The present disclosure generally relates to a driver for driving a light-emitting diode (LED), and more particularly, to a current controlling circuit in a LED driver for accurately controlling LED output current.

DESCRIPTION OF THE RELATED ART

Currently, fully integrated LED driver and current controlling products fail to accurately control LED driving current, because they do not take into consideration offset caused by the system, process variations, parasitic effects, dimming and so on. If a highly accurate current is required, an accurate external resistor needs to be used. However, a ground voltage offset, which varies with the LED output current is a mismatch source in the traditional external resistor-based method.

Moreover, the traditional method cannot support the "LDO (low dropout regulator) mode" (i.e., a mode in which booster input voltage is larger than the required LED) in a boost regulator topology.

SUMMARY OF THE INVENTION

In view of the above, it is desirable to provide a novel circuit and methodology for driving LEDs, so as to address one or more of the above-mentioned problems.

One object of the present disclosure is to enable a fully integrated LED driver to provide good output current accuracy without external components by an auto zero method. Thus, the present disclosure proposes a fully integrated accurate LED output current controlling circuit and method, which can be seamlessly combined with true pulse width modulation (PWM) dimming.

According to one aspect of the present invention, there is provided a current controlling circuit, comprising: a reference current source unit configured to generate a reference current; a current sensing circuit comprising a reference resistor whose first terminal is connected to said reference current source unit, a sensing resistor whose resistance is in a first proportion to the resistance of said reference resistor, a first transistor whose source is connected to a first terminal of said sensing resistor; an error amplifier; and a first switched capacitor circuit configured to sample a reference voltage at the first terminal of said reference resistor when a switching signal is at a first level and to transfer the sampled reference voltage to the first terminal of said sensing resistor when the switching signal is at a second level, such that a voltage at the first terminal of said sensing resistor is equal to a voltage at the first terminal of said reference resistor, wherein an output of said error amplifier is operable to be coupled to a gate of said first transistor through said first switched capacitor circuit, and said current controlling circuit controls a current flowing through said sensing resistor such that the current is in a second proportion to said reference current, said second proportion being a reciprocal of said first proportion.

Preferably, a non-inverting input of said error amplifier is connected to a common mode input voltage, and said first switched capacitor circuit comprises: a first capacitor whose first terminal is connected to an inverting input of said error amplifier; a first switch unit connected between the first terminal of said reference resistor and a second terminal of said first capacitor; a second switch unit connected between the second terminal of said first capacitor and the first terminal of said sensing resistor; a third switch unit connected between the inverting input of said error amplifier and the output of said error amplifier; a fourth switch unit connected between the gate of said first transistor and the output of said error amplifier; wherein the first through fourth switch units in the first switched capacitor circuit are configured such that: when the switching signal is at the first level, the first switch unit and the third switch unit are ON, and the second switch unit and the fourth switch unit are OFF; and when said switching signal is at the second level, the first switch unit and the third switch unit are OFF, and the second switch unit and the fourth switch unit are ON.

Preferably, the current controlling circuit further comprises a second switched capacitor circuit configured to sample a voltage at a second terminal of said reference resistor when the switching signal is at the first level, and to transfer the sampled voltage at the second terminal to a second terminal of said sensing resistor when said switching signal is at the second level, such that a voltage drop across said sensing resistor is equal to a voltage drop across said reference resistor. The second switched capacitor circuit preferably comprises: a second capacitor whose first terminal is connected to a non-inverting input of said error amplifier; a fifth switch unit connected between the second terminal of said reference resistor and a second terminal of said second capacitor; a sixth switch unit connected between the second terminal of said second capacitor and the second terminal of said sensing resistor; a seventh switch unit connected between the non-inverting input of said error amplifier and a common mode input voltage; wherein the fifth through seventh switch units in said second switched capacitor circuit are configured such that: when said switching signal is at the first level, the fifth switch unit and the seventh switch unit are ON, and the sixth switch unit is OFF; and when said switching signal is at the second level, the fifth switch unit and the seventh switch unit are OFF, and the sixth switch unit is ON.

Preferably, said current sensing circuit further comprises a control transistor whose source is connected to a drain of said first transistor and whose gate is connected to a control signal, and said control transistor is configured to be turned off when said control signal is at the first level and to be turned on when said control signal is at the second level.

Preferably, said control signal is a pulse width modulation signal and used as said switching signal.

Preferably, said current controlling circuit further comprises an internal clock and a logical AND circuit, wherein the inputs of said logical AND circuit are connected to said control signal and said internal clock, respectively, and an output of said logical AND circuit is used as said switching signal.

Preferably, the current controlling circuit further comprises a switching signal generating circuit and an internal clock, wherein said switching signal generating circuit is configured such that: said switching signal is at the first level when said control signal is at the first level; and said switching signal becomes the second level when said control signal becomes the second level, but said switching signal varies with said internal clock when the duration during which said control signal is at the second level is larger than a threshold.

Preferably, said current sensing circuit further comprises a holding capacitor connected between a second terminal of said sensing resistor and the gate of said first transistor.

Preferably, said reference current flows from the first terminal of said reference resistor to a second terminal of said reference resistor, the second terminal of said reference resistor and a second terminal of said sensing resistor are connected to ground, and said first transistor is an NMOS transistor.

Preferably, said reference current flows from a second terminal of said reference resistor to the first terminal of said reference resistor, the second terminal of said reference resistor and a second terminal of said sensing resistor are connected to an external voltage, and said first transistor is a PMOS transistor.

Preferably, said reference current source unit comprises a reference current source as well as a second transistor and a third transistor, a gate and a drain of the second transistor as well as a gate of the third transistor are connected together to said reference current source, a source of the second transistor is connected to a drain of the third transistor, and a source of the third transistor is connected to the first terminal of said reference resistor.

According to another aspect of the present invention, there is provided a driver for driving one or more light-emitting diodes connected in series, comprising: a booster circuit configured to output an output voltage larger than an input voltage; and the aforementioned current controlling circuit configured to control a current flowing through the light-emitting diode to a predetermined value and output a feedback voltage and a headroom voltage to said booster circuit so as to regulate said output voltage in a negative feedback manner.

Preferably, said current controlling circuit is connected to a cathode of the light-emitting diode and said output voltage is connected to an anode of the light-emitting diode.

Preferably, said current controlling circuit is connected to an anode of the light-emitting diode, a cathode of the light-emitting diode is connected to ground, and said output voltage is connected to the second terminals of said sensing resistor and said reference resistor.

Preferably, said booster circuit comprises another error amplifier, wherein said current controlling circuit further comprises a control transistor whose source is connected to the drain of said first transistor, whose gate is connected to the control signal, and whose drain is connected to an anode or a cathode of the light-emitting diode; wherein said reference current source unit comprises a reference current source as well as a second transistor and a third transistor, a gate and a drain of the second transistor as well as a gate of the third transistor are connected together to said reference current source, a source of the second transistor is connected to a drain of the third transistor, a source of the third transistor is connected to the first terminal of said reference resistor; wherein a voltage at the source of the second transistor is outputted to a non-inverting input of said another error amplifier as said headroom voltage, and a voltage at the drain of the first transistor is outputted to an inverting input of said another error amplifier as said feedback voltage.

According to a further aspect of the present invention, there is provided a method for producing a current controlling circuit, comprising: providing a reference current source unit to produce a reference current; providing a current sensing circuit, wherein said current sensing circuit includes a reference resistor whose first terminal is connected to said reference current source unit, a sensing resistor whose resistance is in a first proportion to a resistance of said reference resistor, an error amplifier, and a first transistor whose source is connected to said sensing resistor; and providing a first switched capacitor circuit so as to sample a reference voltage at the first terminal of said reference resistor when a switching signal is at a first level and transfer said sampled reference voltage to a first terminal of said sensing resistor when the switching signal is at a second level, such that a voltage at the first terminal of said sensing resistor is equal to a voltage at the first terminal of said reference resistor; wherein an output of said error amplifier is operable to be coupled to a gate of said first transistor through said first switched capacitor circuit, and a current flowing through said sensing resistor is made to be in a second proportion to said reference current by means of said current controlling circuit, said second proportion being a reciprocal of said first proportion.

According to another further aspect of the present invention, there is provided a method for producing a driver for driving one or more light-emitting diodes connected in series, comprising: providing a booster circuit to output an output voltage larger than an input voltage; and providing the aforementioned current controlling circuit to control a current flowing through the light-emitting diode to a predetermined value and output a feedback voltage and a headroom voltage to said booster circuit so as to regulate said output voltage in a negative feedback manner.

One advantage of the present circuit is in that, an offset caused by the system, process variation, parasitic effects, dimming and so on can be eliminated by using a current controlling circuit having an auto zero function, such that the LED current can be controlled with a high accuracy. Moreover, the driver of the present disclosure does not need external components such as an external resistor to regulate current accuracy.

Another advantage of the present disclosure is in that the current controlling circuit according to the present disclosure can be seamlessly applied to the true PWM dimming LED driver, and when the true PWM dimming function is enabled, the influence on the LED current produced by the variation of the ground voltage of the chip between the on/off states of the LED current path due to board level parasitic resistance can be eliminated.

A further advantage of the present circuit is in that the current controlling circuit according to the present disclosure uses a resistor as a sensing element and thus can achieve better match performance in the same chip area as would a transistor current mirror structure used as a sensing circuit.

A further advantage of the present circuit is in that the LED booster driver according to the present disclosure can also support the LDO mode.

A further advantage of the present circuit is in that, with the present invention, the small signal feedback ratio between the feedback voltage and the output voltage outputted from the current controlling circuit to the booster circuit can be kept stable—without varying greatly with the LED current—such that the design of loop stability can be facilitated.

A further advantage of the present circuit is in that the current controlling circuit according to the present disclosure can self-adaptively output a headroom reference voltage, thereby improving output performance.

Other aspects and advantages of the present disclosure will become apparent from the following detailed description of exemplary embodiments with reference to the accompanying drawings.

BRIEF DESCRIPTION OF THE DRAWINGS

Hereinafter, the detailed description of some exemplary embodiments will be better understood when read in conjunction with the drawings. However, it should be understood that the exemplary embodiments are not limited to the illustrated precise arrangement and means. In the drawings, similar numbers are used to indicate similar elements.

For the sake of simplicity and clarity of illustration, the drawings show a general manner of the structure, in which descriptions and details about the known features and technologies may be omitted such that the illustrated embodiments will not be unnecessarily obscured. In addition, the elements in the figures have not been necessarily drawn in scale. For example, some elements or regions in some figures can be enlarged as compared to other elements or regions in the same or other figures, for facilitating the understanding of the illustrated embodiments.

DETAILED DESCRIPTION OF THE PREFERRED EMBODIMENT

The preferred embodiments of the present disclosure will be described below with reference to the drawings.

It should be noted that the following detailed description set forth in conjunction with the accompanying drawings serves as description about some exemplary embodiments, but is not intended to completely describe all possible embodiments. It should be understood that the same or equivalent functions can be achieved by different embodiments. Moreover, the following description of at least one exemplary embodiment is merely illustrative and is in no way intended to limit the invention, its application or uses.

It should be noted that the relative arrangement of the components and steps, the numerical expressions, and numerical values set forth in these embodiments do not limit the scope of the present disclosure unless it is specifically stated otherwise. In all embodiments discussed herein, any particular values should be construed as illustrative and not limiting. Thus, other examples of the exemplary embodiments can have different values.

Techniques, methods and apparatus as known by those skilled in the art may not be discussed in detail, but are intended to be part of the specification where appropriate.

In the following description as well as in the claims, words like "first", "second", "third", "fourth" or the like (if present) are used to distinguish similar elements but not for describing a specific sequence or chronological order. Moreover, words like "comprise", "include", "have" and their variations mean nonexclusive inclusion, such that process, method, object or device comprising, including or having a series of elements are not necessarily limited to these elements, but can comprise other elements not explicitly listed or other elements inherent to the process, the method, the object or the device.

Figure 1:
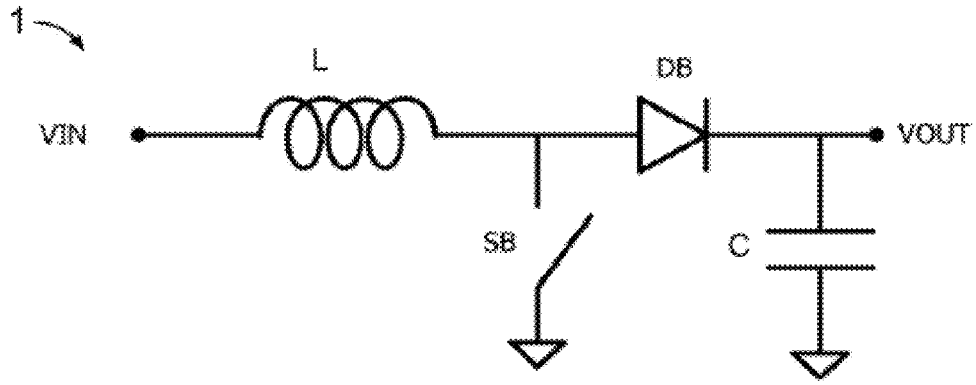
FIG. 1 PRIOR ART
FIG. 1 shows a basic structure of a known boost converter.

In the prior art, a LED driver can be implemented by a booster circuit. The booster circuit generally comprises a boost converter and a boost regulator feedback loop. FIG. 1 is a diagram showing the basic structure of a boost converter in the prior art. The boost converter 1 is configured to receive an input voltage VIN and to produce an output voltage VOUT having an amplitude larger than that of the input voltage VIN. When a switch SB is closed, the current flowing through an inductor L increases and the energy from the input voltage VIN is stored in the inductor L. When the switch SB is open, there is still a current flowing through the inductor L, and the previously stored energy is transferred to the output via a diode DB. In an ideal situation (i.e. without energy loss), VOUT=VIN/(1-D), where D is a duty ratio of a control signal operating switch SB, i.e. a ratio of the ON time of the switch SB to the entire cycle. The amplitude of the output voltage can be regulated by regulating the value of the duty ratio D.

A boost regulator feedback loop is used to regulate the amplitude of the output voltage to a proper value such that the amplitude of the current flowing through an LED is a predetermined value. Therefore, in the boost regulator circuit, there is a circuit for sensing LED current and feeding back the LED current to the boost regulator loop so as to control the output voltage.

However, in the LED driver according to the prior art, there is no current controlling circuit for accurately controlling the LED current. Thus, the present disclosure proposes a current controlling circuit which can both sense the LED current so as to provide a feedback signal for the boost regulator circuit, and accurately control the current flowing through the LED to a predetermined value. The current controlling circuit can be connected to the cathode of the LED so as to achieve a low side sensing mode (i.e. sensing the LED current on the downstream side of the LED), or can be connected to the anode of the LED so as to achieve a high side sensing mode (i.e. sensing LED current upstream of the LED).

Figure 2:
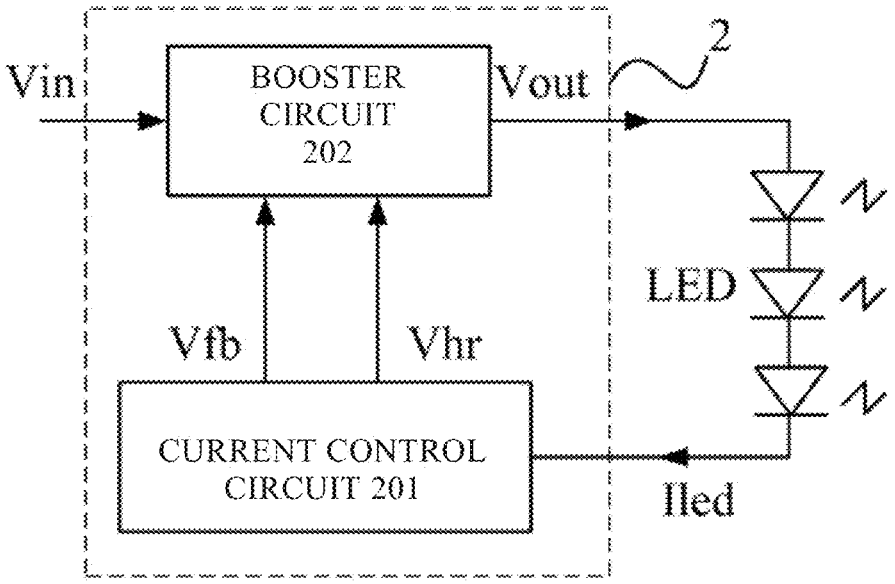
FIG. 2 shows a schematic block diagram of an LED driver in a low side sensing situation.
Figure 3:
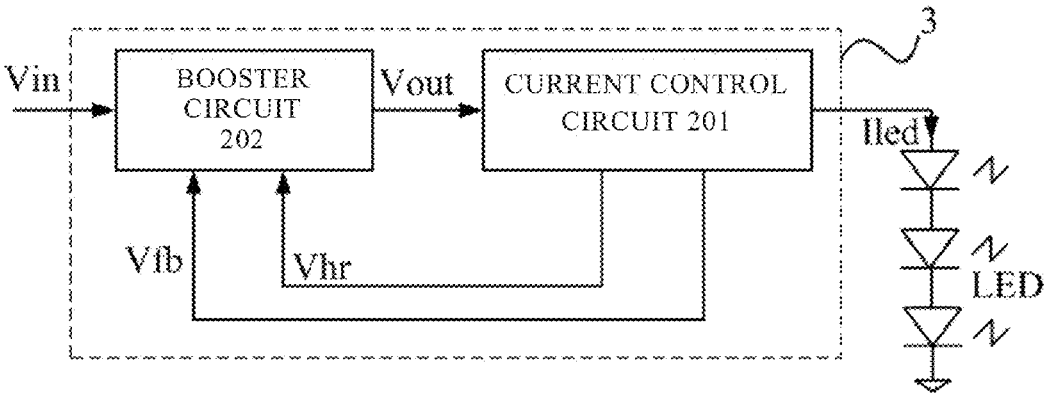
FIG. 3 shows a schematic block diagram of an LED driver in a high side sensing situation.

FIG. 2 and FIG. 3 show schematic block diagrams of an LED driver 2 and an LED driver 3 in a low side sensing situation and in a high side sensing situation, respectively, according to the present invention.

With reference to FIGS. 2 and 3, the LED drivers 2 and 3 are used to drive three light-emitting diodes (LEDs) connected in series. Those skilled in the art should understand that the three LEDs connected in series shown in FIG. 2 and FIG. 3 are merely illustrative, and that an LED driver according to the present disclosure can be used to drive one or more LEDs connected in series.

The operation of the LED driver will be described first with the example of the LED driver 2 in a low side sensing situation. With reference to FIG. 2, the LED driver 2 comprises a booster circuit 202 for outputting an output voltage having an amplitude larger than that of an input voltage, and a current controlling circuit 201 described in detail later. The current controlling circuit 201 is configured to control the amplitude of the current Iled flowing through the LED to a predetermined value that is proportional to a reference current value, and to output a headroom voltage Vhr and a feedback voltage Vfb to the booster circuit 202 so as to regulate the output voltage in a negative feedback manner. The booster circuit 202 can employ any structure known by those skilled in the art. For example, as described above, the booster circuit 202 can include a boost converter and a boost regulator circuit, wherein the boost regulator circuit receives the headroom voltage Vhr and the feedback voltage Vfb and controls the boost converter by comparing the headroom voltage Vhr with the feedback voltage Vfb, thereby regulating the output voltage to a proper voltage value. Since the structures and principles of the boost converter and the voltage regulator circuit are known to those skilled in the art, these circuits will not be described in detail in the present application.

In the low side sensing situation shown in FIG. 2, the current controlling circuit 201 is connected to the cathode of the LED, and the output voltage of the booster circuit 202 is connected to the anode of the LED. On the other hand, in the high side sensing situation shown in FIG. 3, the output voltage of the booster circuit 202 is outputted to the current controlling circuit 201, the current controlling circuit 201 is connected to the anode of the LED, and the cathode of the LED is connected to ground.

In the high side sensing mode, the structure of the booster circuit 202 can be identical to that in the low side sensing mode, and the operation principle of the current controlling circuit 201 can be similar to that in the low side sensing mode. Thus, the structure and principle of the current controlling circuit will be described in detail by taking the current controlling circuit in the low side sensing mode as an example.

Figure 4:
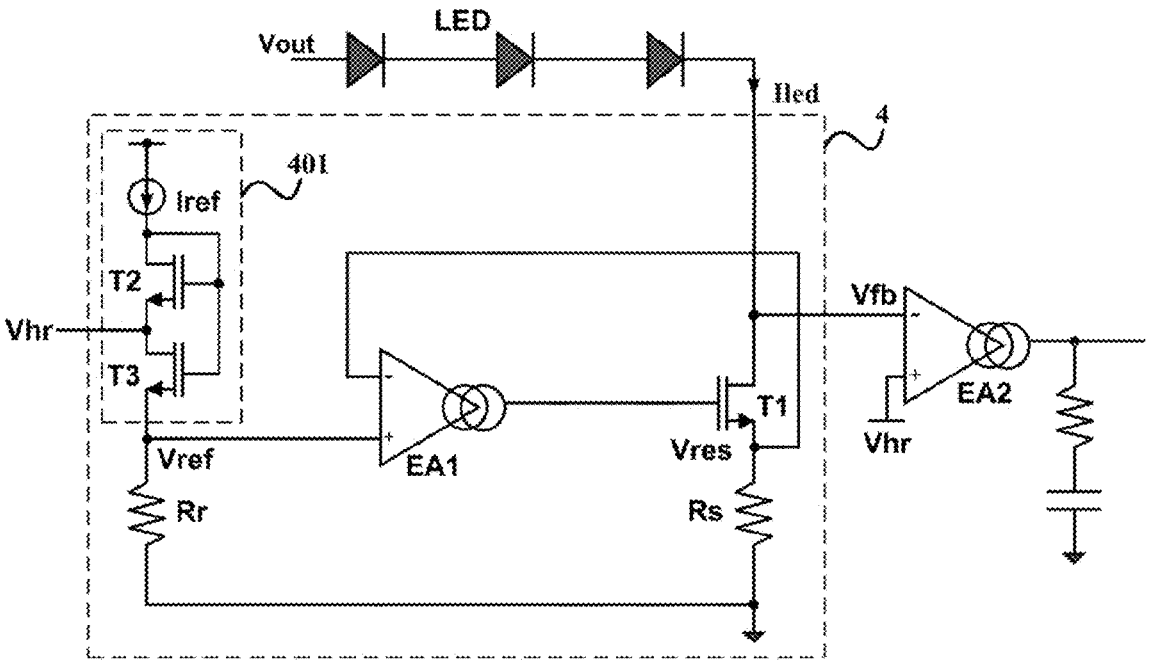
FIG. 4 shows a basic structure of an ideal current controlling circuit in a situation where various LED driver offsets are not considered and dimming is not executed.

FIG. 4 shows a basic structure of an ideal current controlling circuit 4 in a situation where various offsets in the LED driver are not considered and dimming is not done.

As described above, in the low side sensing mode, the current controlling circuit 4 is connected to the cathode of the LED, and the output voltage Vout of the booster circuit (not shown) is connected to the anode of the LED. The current controlling circuit 4 outputs a headroom voltage Vhr and a feedback voltage Vfb to the boost regulator circuit. As shown in FIG. 4, the boost regulator circuit can comprise an error amplifier EA2 whose non-inverting input receives the headroom voltage Vhr and whose inverting input receives the feedback voltage Vfb.

The current controlling circuit 4 includes a reference current source unit 401 for generating a reference current Iref, and a current sensing circuit portion for sensing the LED current.

The current sensing circuit portion comprises a reference resistor Rr, a sensing resistor Rs, an error amplifier EA1 and a first transistor T1. The first terminal of the reference resistor Rr is connected to the reference current source unit 401 (i.e. the source of a third transistor T3) and the non-inverting input of the error amplifier EA1, and the second terminal of the reference resistor Rr is connected to ground. The first terminal of the sensing resistor Rs is connected to the source of a first transistor T1 and the inverting input of the error amplifier EA1, and the second terminal of the sensing resistor Rs is connected to ground. The gate of the first transistor T1 is connected to the output of the error amplifier EA1, and the voltage of the drain of the first transistor T1 is outputted to the inverting input of the error amplifier EA2 as the feedback voltage Vfb.

The reference current source unit 401 comprises a reference current source as well as second transistor T2 and third transistor T3, wherein the gate and the drain of the second transistor T2 as well as the gate of the third transistor T3 together are connected to the reference current source, the source of the second transistor T2 is connected to the drain of the third transistor T3, and the source of the third transistor T3 is connected to the current sensing circuit portion. In addition, the voltage at the source of the second transistor T2 is outputted to the non-inverting input of the error amplifier EA2 as the headroom voltage Vhr.

The headroom voltage Vhr is a voltage provided for ensuring the normal operation of the first transistor T1. Through the feedback loop, the feedback voltage Vfb is controlled at the headroom voltage Vhr. That is to say, the headroom voltage Vhr controls the total voltage drop on both the first transistor T1 and the sensing resistor Rs. The headroom voltage in the prior art is a fixed voltage; that is, the total voltage drop on both the first transistor T1 and the sensing resistor Rs is fixed. However, in order to ensure that the voltage across the source and the drain of the first transistor T1 are sufficient when the LED current is high (correspondingly, the voltage drop across the sensing resistor Rs is large), the headroom voltage is typically set as a fixed voltage with relatively larger amplitude. However, when the LED current is low, the voltage drop on the first transistor T1 becomes larger, but it is unnecessary for the voltage drop on the first transistor T1 to be so large.

However, in the circuit structure according to the present invention, when the LED output current is low, the headroom voltage Vhr is low, and when the LED output current is high, the headroom voltage Vhr is high. That is to say, the current controlling circuit according to the present disclosure can self-adaptively output a headroom reference voltage Vhr. Thus, as compared with the fixed headroom voltage in the prior art, for the same output voltage, the headroom voltage according to the present disclosure is smaller when the LED output current is low, and thus the voltage actually across the LED is larger, which is good for enhancing system efficiency in a situation of a small LED output current.

The resistance of the sensing resistor Rs is in a first proportion N to the resistance of the reference resistor Rr; that is to say, assuming that the resistance of the reference resistor Rr is R, the resistance of the sensing resistor Rs is NR. The error amplifier EA1 can be a transconductance operational amplifier.

When the current controlling circuit 4 operates stably, under the control of the feedback loop, the non-inverting input voltage of the error amplifier EA1 is equal to its inverting input voltage. That is to say, the voltage Vref at the first terminal of the reference resistor Rr is equal to the voltage Vres at the first terminal of the sensing resistor Rs. Moreover, because the input impedance of the error amplifier is very large, the current flowing through the input of the error amplifier approximates to zero, so that the current flowing through the reference resistor Rr is the reference current Iref and the current flowing through the sensing resistor Rs is the LED current Iled. Therefore, the relationship between the LED current Iled and the reference current Iref can be deduced as follows, and this relationship can be expressed by the following formula 1.

$$V\text{ref}=V\text{res}\rightarrow I\text{ref}\times Rr=I\text{led}\times Rs\rightarrow I\text{led}=I\text{ref}\times Rr/Rs=I\text{ref}/N \quad \text{(formula 1)}$$

It can be seen from formula 1 that the ratio of the LED current Iled (i.e. the current flowing through the sensing resistor) to the reference current Iref is 1/N. Thus, the current controlling circuit 4 controls the current flowing through the sensing resistor so as to make it in a second proportion (i.e. 1/N) to the reference current, wherein the second proportion is a reciprocal of the first proportion N.

However, in actual situations, due to offsets caused by the system, process variations, parasitic effects and the like, there is an offset between Vres and Vref, which causes the current controlling circuit 4 to fail to accurately control the LED current.

Thus, a current controlling circuit capable of automatically eliminating an offset is now described in detail.

The inventors have noticed that, the offset of the error amplifier EA1 is a main factor that influences LED current accuracy, especially in a situation of a small LED current. In view of this, in the present invention, a switched capacitor circuit is added to the basic current controlling circuit 4 so as to automatically eliminate an offset. The switched capacitor circuit is configured to sample the reference voltage Vref at the first terminal of the reference resistor Rr when the switching signal is at a first level (i.e. phase 1 of the switched capacitor circuit) and transfer the sampled reference voltage to the first terminal of the sensing resistor Rs when the switching signal is at a second level (i.e. phase 2 of the switched capacitor circuit), such that the voltage Vres at the first terminal of the sensing resistor Rs is equal to the voltage Vref at the first terminal of the reference resistor Rr. Therefore, the influence of offsets on the voltage Vres of the sensing resistor Rs is eliminated, such that the voltage Vres of the sensing resistor Rs is accurately equal to the reference voltage Vref of the reference resistor Rr, and thus the LED current can be accurately controlled.

Figure 5A:
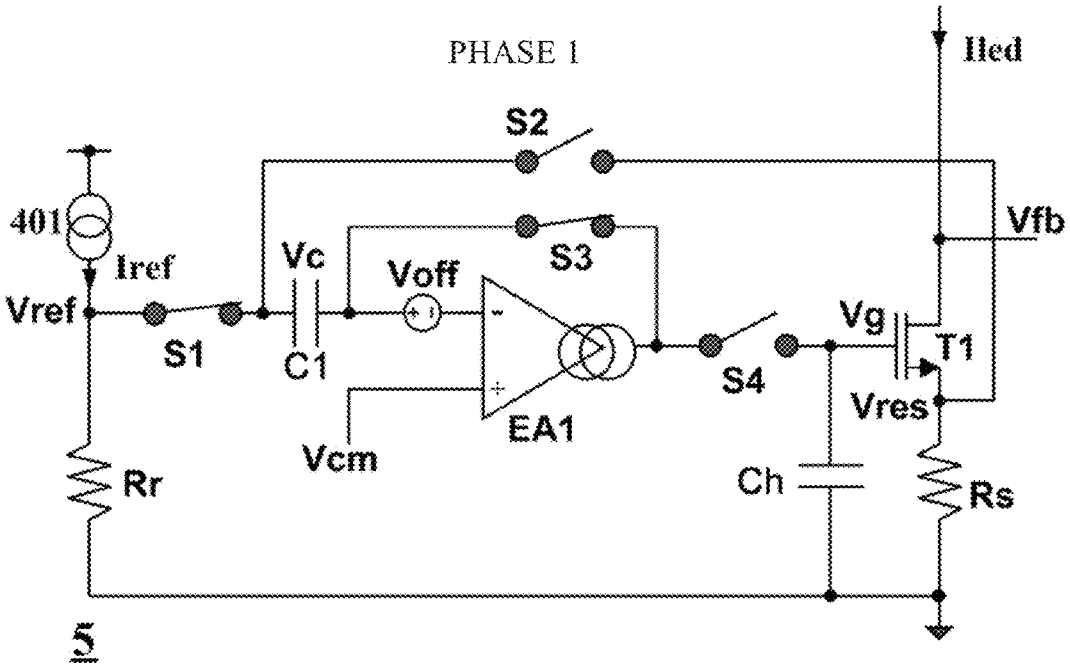
FIG. 5A and FIG. 5B illustratively show circuit diagrams of the current controlling circuit having a switched capacitor circuit, during two phases (phase 1 and phase 2, respectively) according to the present invention.
Figure 5B:
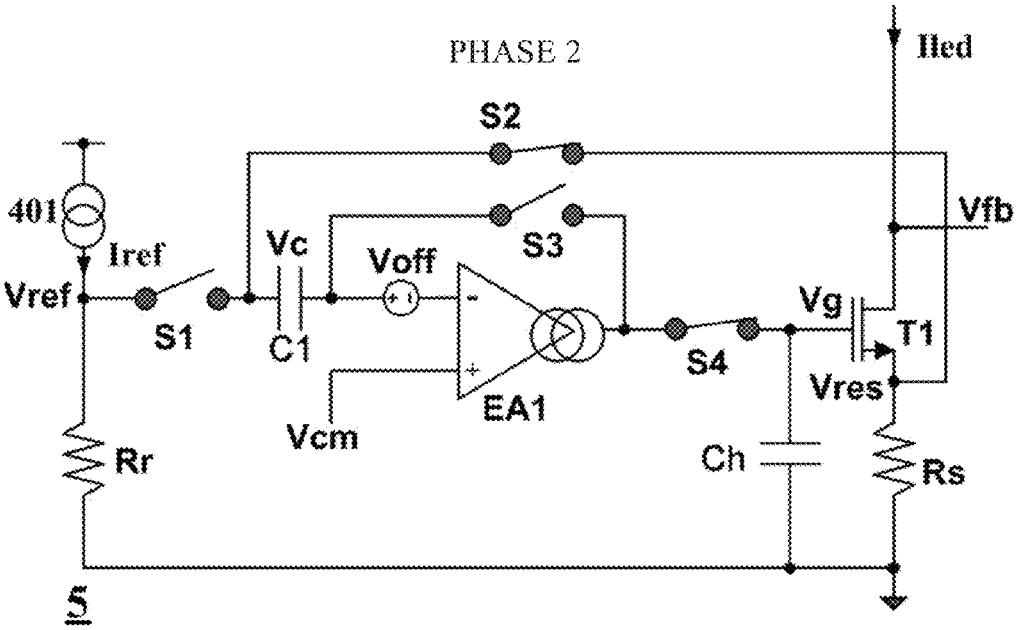

FIG. 5A and FIG. 5B respectively show circuit diagrams of a current controlling circuit 5 having a switched capacitor circuit at two phases (phase 1 and phase 2) of the switched capacitor circuit, according to one embodiment of the present invention.

The current controlling circuit 5 according to this embodiment comprises a reference current source unit 401 configured to generate a reference current Iref, a current sensing circuit and a first switched capacitor circuit.

The structure of the reference current source unit 401 of this embodiment is preferably identical to that of the reference current source unit 401 as shown in FIG. 4, and thus description thereof will not be repeated.

The current sensing circuit of this embodiment comprises a reference resistor Rr, a sensing resistor Rs, an error amplifier EA1 and a first transistor T1. The first terminal of the reference resistor Rr is connected to the reference current source unit 401. The source of the first transistor T1 is connected to the first terminal of the sensing resistor Rs. The second terminal of the reference resistor Rr and the second terminal of the sensing resistor Rs are both connected to the ground. The first transistor T1 can be an NMOS transistor.

The first switched capacitor circuit comprises: a first capacitor C1, a first switch unit S1, a second switch unit S2, a third switch unit S3 and a fourth switch unit S4. The first terminal of the first capacitor C1 is connected to the inverting input of the error amplifier EA1. The first switch unit S1 is connected between the first terminal of the reference resistor Rr and the second terminal of the first capacitor C1. The second switch unit S2 is connected between the second terminal of the first capacitor C1 and the first terminal of the sensing resistor Rs. The third switch unit S3 is connected between the inverting input of the error amplifier EA1 and the output of the error amplifier EA1. The fourth switch unit S4 is connected between the gate of the first transistor T1 and the output of the error amplifier EA1. The first switch unit through the fourth switch unit S1-S4 in the first switched capacitor circuit are configured such that when the switching signal is at the first level, the first switch unit S1 and the third switch unit S3 are ON and the second switch unit S2 and the fourth switch unit S4 are OFF (as shown in FIG. 5A), and when the switching signal is at the second level, the first switch unit S1 and the third switch unit S3 are OFF and the second switch unit S2 and the fourth switch unit S4 are ON (as shown in FIG. 5B). The first switch unit through the fourth switch unit S1-S4 can be an NMOS switch, a PMOS switch, a CMOS switch, or the like.

The non-inverting input of the error amplifier EA1 is connected to a common mode input voltage Vcm. As known by those skilled in the art, a common mode input voltage Vcm is set such that the error amplifier EA1 can operate normally.

In addition, FIG. 5A and FIG. 5B also show a holding capacitor Ch which is connected between the second terminal of the sensing resistor Rs and the gate of the first transistor T1 and used to maintain the gate voltage Vg of the first transistor T1 when the fourth switch unit S4 is OFF. However, those skilled in the art should understand that the holding capacitor Ch is not essential, so long as the design of the current controlling circuit can make the gate voltage Vg of the first transistor T1 keep stable when S4 is OFF.

In FIG. 5A and FIG. 5B, the voltage source Voff at the non-inverting input of the error amplifier EA1 is virtual and used for the analog representation of the offset of the error amplifier EA1. That is to say, in practice, there is an offset between the voltages at the two inputs of error amplifier EA1, and this offset is represented by Voff.

Below, how the current controlling circuit 5 according to this embodiment automatically eliminates an offset is described in detail.

Firstly, as shown in FIG. 5A, at phase 1, the reference voltage Vref is sampled. That is, the voltage at the second terminal of the first capacitor C1 is Vref and the voltage at the first terminal of the first capacitor C1 is (Voff+Vcm), and thus the voltage Vc across the first capacitor C1 is equal to (Vref−Voff−Vcm).

Next, as shown in FIG. 5B, at phase 2, the first switch unit S1 is OFF and the second switch unit S2 is ON. Since there is no current flowing into C1, there will be no current flowing out of C1, so that the voltage Vc across C1 keeps unchanged. Therefore, at phase 2, the reference voltage sampled at phase 1 is transferred to the first terminal of the sensing resistor Rs. That is to say:

$$\begin{aligned} V_{res} &= (V_{off}+V_{cm})+V_c=(V_{off}+V_{cm})+(V_{ref}-V_{off}-V_{cm}) \\ &= V_{ref} \end{aligned}$$

It can be seen from the above expression that the voltage Vres of the sensing resistor Rs is accurately equal to the reference voltage Vref of the reference resistor Rr, and the influence of the offset is eliminated.

As described in the aforementioned formula 1, in a situation where the resistance of the sensing resistor Rs is in a first proportion to the resistance of the reference resistor Rr, the ratio of the LED current Iled (i.e. current flowing through the sensing resistor Rs) to the reference current Iref is 1/N. Thus, the current controlling circuit 5 can accurately control the LED current such that the LED current is in a second proportion (i.e. 1/N) to the reference current.

With the present invention, a current controlling circuit having an auto zero function can be used to eliminate the offset in a LED driver application, and thus the LED current can be controlled with high accuracy. Moreover, in the present invention, additional components like the external resistor are not necessary to regulate the current accuracy.

In addition, the current controlling circuit according to the present disclosure uses a resistor as a sensing element, and thus a better match performance for the same chip area can be achieved as compared with a situation where a transistor current mirror structure is used as a sensing circuit.

Figure 9:
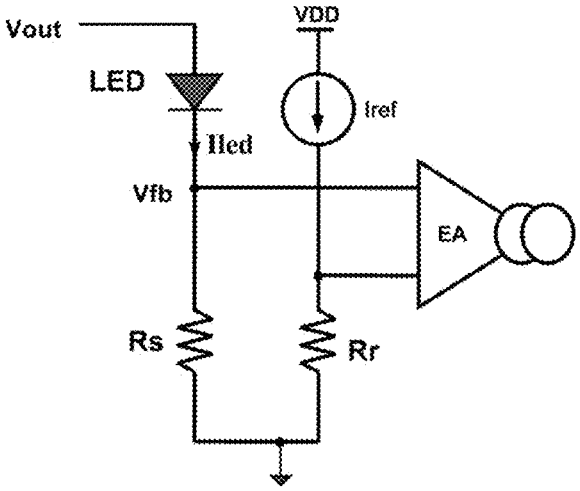
FIG. 9 PRIOR ART
FIG. 9 shows a schematic diagram of a traditional simple resistor based LED current sensing circuit.

Moreover, in the traditional LED current sensing circuit, the ratio (i.e. feedback ratio) between the feedback voltage and the output voltage varies with the LED current significantly. As an example, FIG. 9 shows a schematic diagram of a traditional simple resistor-based LED current sensing circuit. It can be seen from FIG. 9 that the ratio (i.e. feedback ratio) between the feedback voltage Vfb and the output voltage Vout is Rs/(Rs+R1), wherein R1 is an equivalent resistance of an LED. Since the equivalent resistance of an LED is in reverse proportion to the current flowing through the LED, i.e. the equivalent resistance of an LED increases as the current flowing through the LED decreases, the feedback ratio becomes smaller as the LED current decreases, which reduces loop gain and makes the circuit become unstable.

However, since a transistor which operates in a saturation region is used in the feedback path of the current sensing circuit according to the present invention, the feedback ratio between the feedback voltage and the output voltage outputted from the current controlling circuit to the booster circuit can be kept stable, instead of varying significantly with the LED current. Specifically with reference to FIG. 4, 5A or 5B, it can be obtained that the feedback ratio Vref/Vout according to the present disclosure is (Rs+Rt1)/(Rs+Rt1+R1), wherein R1 is an equivalent resistance of an LED and Rt1 is an equivalent resistance across the source and the drain of the first transistor T1. Since Rt1 is also in a reverse proportion to the drain current (i.e. the current flowing through the LED) of T1, the feedback ratio according to the present disclosure keeps stable and will not vary significantly with the LED current.

Moreover, the LED boost driver according to the present disclosure can also support LDO mode. For example, when the output voltage of the LED driver is 5V, the required voltage across one LED is 3.5V, and when the LED driver only drives one LED, the required output voltage should be smaller than the input voltage; i.e. it is required to operate in the so-called LDO mode. However, although the output voltage Vout of the booster circuit will be larger than the input voltage, the current controlling circuit according to the present disclosure can make the excessive voltage drop in the output voltage Vout of the booster circuit fall across the source and the drain of the first transistor T1, and thus can support the LDO mode.

Figure 6A:
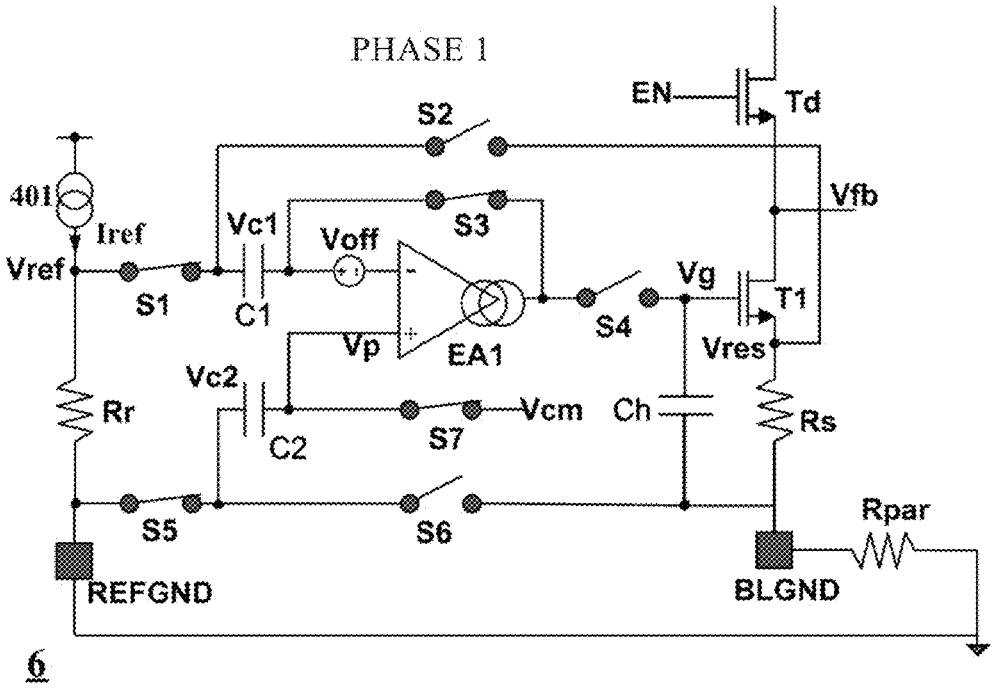
FIG. 6A and FIG. 6B illustratively show circuit diagrams of the current controlling circuit having two switched capacitor circuit during two phases (phase 1 and phase 2, respectively) of the switched capacitor circuit according to the present invention.
Figure 6B:
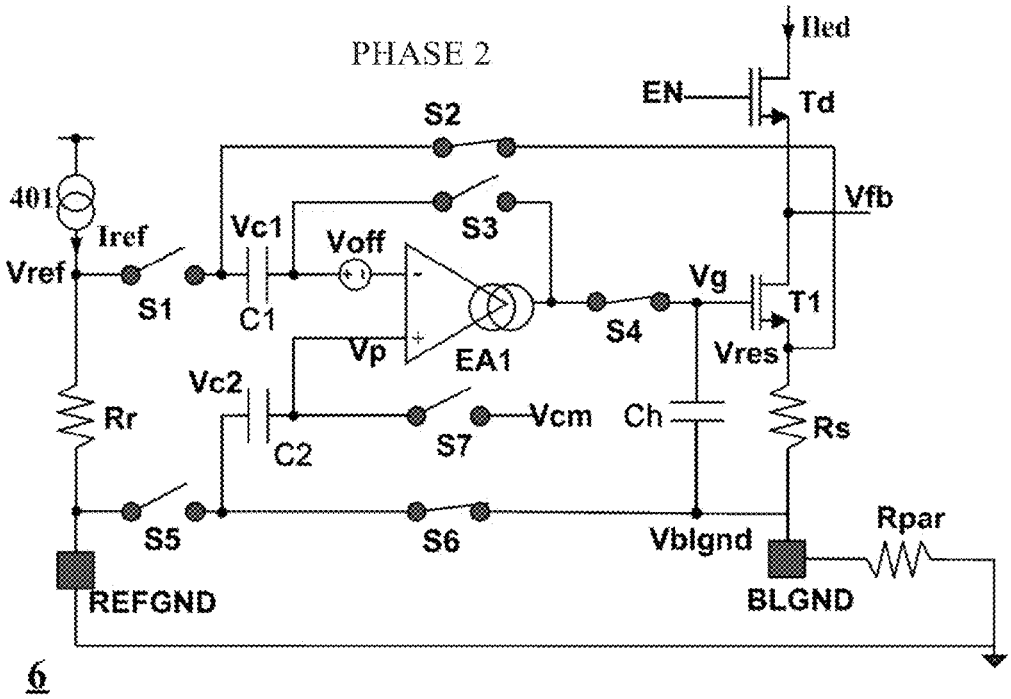

Although FIG. 5A and FIG. 5B do not show a dimming circuit, those skilled in the art should understand that the aforementioned current controlling circuit can be used in conjunction with a dimming circuit or element, so as to controllably regulate the LED brightness level. For example, the aforementioned current controlling circuit 5 can perform true PWM dimming by adding a control transistor between the LED and the first transistor T1 (as shown in FIG. 6A and FIG. 6B described below). True PWM dimming regulates the LED brightness level by keeping the current unchanged when the LED is ON and changing the ON time of the LED. That is to say, the LED brightness is controlled by regulating the relative proportion between the amount of the ON time and the amount of the OFF time of the LED. Human eyes will not perceive flicker so long as the switching speed of the LED is quick enough, but only see an effective brightness in proportion to the duty ratio of the ON time of the LED. Since true PWM dimming will not change the amplitude of the ON current of the LED, there is an advantage of not changing color temperature.

Those skilled in the art should understand that in addition to true PWM dimming, the current controlling circuit according to the present disclosure also can be applied to other forms of dimming.

In the aforementioned current controlling circuit 5, accurate control of the LED current can be achieved by connecting the second terminal of the sensing resistor Rs and the second terminal of the reference resistor Rr to ground and making the voltage Vres at the first terminal of the sensing resistor Rs accurately equal to the voltage Vref at the first terminal of the reference resistor Rr. However, the inventors of the present disclosure have recognized that, in some applications, because the second terminal of the reference resistor Rr and the second terminal of the sensing resistor Rs are respectively connected to different ground terminals of the chip and because there may be a ground voltage offset between the different ground terminals due to parasitics on the circuit board on which the chip is mounted, there is an offset caused by parasitics between the voltage at the second terminal of the reference resistor Rr and the voltage at the second terminal of the sensing resistor Rs. Therefore, in order to more accurately control the LED current, another switched capacitor circuit can be added to the basic current controlling circuit 5 to eliminate the influence on the LED current caused by the offset between the voltage at the second terminal of the reference resistor Rr and the voltage at the second terminal of the sensing resistor Rs.

In view of this, in this embodiment, a current controlling circuit is proposed which further comprises a second switched capacitor circuit, wherein said second switched capacitor circuit is configured to sample the voltage at the second terminal of the reference resistor when the switching signal is at the first level and transfer the sampled voltage at the second terminal to the second terminal of the sensing resistor when the switching signal is at the second level, such that the voltage drop across the sensing resistor is equal to the voltage drop across the reference resistor. That is to say, the current controlling circuit according to this embodiment can make the voltage drop across the sensing resistor Rs accurately equal to the voltage drop across the reference resistor Rr through two switched capacitor circuits. Below, with reference to FIG. 6A and FIG. 6B, the current controlling circuit 6 according to this embodiment will be described. FIG. 6A and FIG. 6B respectively show circuit diagrams of a current controlling circuit 6 having two switched capacitor circuits at two phases (phase 1 and phase 2) of the switched capacitor circuit, according to this embodiment.

The current controlling circuit 6 comprises a reference current source unit 401 configured to generate a reference current Iref, a current sensing circuit, a first switched capacitor circuit and a second switched capacitor circuit.

The structure of the reference current source unit 401 of this embodiment is identical to that of the reference current source unit 401 shown in FIG. 4, and thus description thereof will not be repeated.

The current sensing circuit of this embodiment comprises a reference resistor Rr, a sensing resistor Rs, an error amplifier EA1 and a first transistor T1. The first terminal of the reference resistor Rr is connected to the reference current source unit 401. The source of the first transistor T1 is connected to the first terminal of the sensing resistor Rs. The second terminal of the reference resistor Rr is connected to the reference ground terminal (REFGND) of the chip and the second terminal of the sensing resistor Rs is connected to another reference ground terminal (BLGND) of the chip. The first transistor T1 can be an NMOS transistor.

The first switched capacitor circuit comprises: a first capacitor C1, a first switch unit S1, a second switch unit S2, a third switch unit S3 and a fourth switch unit S4. The first terminal of the first capacitor C1 is connected to the inverting input of the error amplifier EA1. The first switch unit S1 is connected between the first terminal of the reference resistor Rr and the second terminal of the first capacitor C1. The second switch unit S2 is connected between the second terminal of the first capacitor C1 and the first terminal of the sensing resistor Rs. The third switch unit S3 is connected between the inverting input of the error amplifier EA1 and the output of the error amplifier EA1. The fourth switch unit S4 is connected between the gate of the first transistor T1 and the output of the error amplifier EA1. The first switch unit through the fourth switch unit S1-S4 in the first switched capacitor circuit are configured as: when the switching signal is at the first level, the first switch unit S1 and the third switch unit S3 are ON, and the second switch unit S2 and the fourth switch unit S4 are OFF (as shown in FIG. 6A); and when the switching signal is at the second level, the first switch unit S1 and the third switch unit S3 are OFF, and the second switch unit S2 and the fourth switch unit S4 are ON (as shown in FIG. 6B). The first switch unit through the fourth switch unit S1-S4 can be an NMOS switch, a PMOS switch, a CMOS switch, or the like.

The second switched capacitor circuit comprises: a second capacitor C2, a fifth switch unit S5, a sixth switch unit S6, and a seventh switch unit S7. The first terminal of the second capacitor C2 is connected to the non-inverting input of the error amplifier EA1. The fifth switch unit S5 is connected between the second terminal of the reference resistor Rr and the second terminal of the second capacitor C2. The sixth switch unit S6 is connected between the second terminal of the second capacitor C2 and the second terminal of the sensing resistor Rs. The seventh switch unit S7 is connected between the non-inverting input of the error amplifier EA1 and a common mode input voltage Vcm. As known by those skilled in the art, common mode input voltage Vcm is set such that the error amplifier EA1 can operate normally. In addition, the fifth switch unit through the seventh switch unit S5-S7 in the second switched capacitor circuit are configured as: when the switching signal is at the first level, the fifth switch unit S5 and the seventh switch unit S7 are ON, and the sixth switch unit is OFF (as shown in FIG. 6A); and when the switching signal is at the second level, the fifth switch unit S5 and the seventh switch unit S7 are OFF, and the sixth switch unit is ON (as shown in FIG. 6B). The fifth switch unit through the seventh switch unit S5-S7 can be an NMOS switch, a PMOS switch, a CMOS switch, or the like.

In addition, FIG. 6A and FIG. 6B also show a holding capacitor Ch which is connected between the second terminal of the sensing resistor Rs and the gate of the first transistor T1 and used to maintain the gate voltage Vg of the first transistor T1 when the fourth switch unit S4 is OFF. However, those skilled in the art should understand that the holding capacitor Ch is not essential, so long as the gate voltage Vg of the first transistor T1 can be kept stable when S4 is OFF in the design of the current controlling circuit of the present invention.

Moreover, FIG. 6A and FIG. 6B also show a control transistor Td which performs dimming by controlling the ON or OFF of the LED current path. The control transistor Td can be an NMOS transistor. The source of the control transistor Td is connected to the drain of the first transistor T1, the drain is connected to the cathode of the LED, and the gate is connected to a control signal EN. Those skilled in the art should understand that when the current controlling circuit 6 according to this embodiment is applied to the LED driver that requires no dimming, the current controlling circuit 6 can include no control transistor Td. When the LED driver does not require dimming, the control transistor Td can always be ON.

When the LED driver performs true PWM dimming, the control signal of the control transistor Td is a pulse width modulation signal, and at this point, the control signal can be used as a switching signal of the switched capacitor circuit. In a situation where the first level of the switching signal is a low level and the second level is a high level, the switched capacitor circuit is in phase 1 when the control transistor Td is OFF, and the switched capacitor circuit is in phase 2 when the control transistor Td is ON.

Figure 7A:
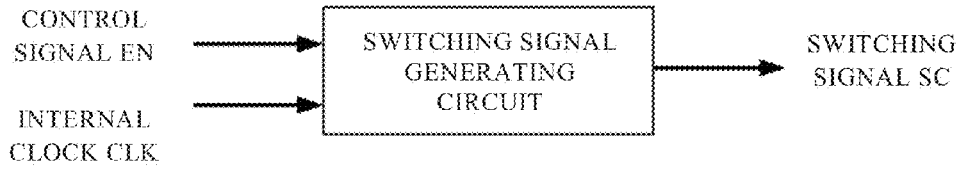
FIG. 7A shows a diagram of a switching signal generating circuit.

Since the first capacitor and the second capacitor will discharge slowly in actual situations, the switched capacitor circuit cannot stay at phase 2 for a long period. However, when a large brightness level is required, it is requested that the ON time of the transistor should be relatively longer, which may result in the time period during which the switched capacitor circuit stays in phase 2 being too long. Thus, the present disclosure also provides an internal clock, and this internal clock and control signal are combined to generate a switching signal. For example, the current controlling circuit 6 can also comprise an internal clock Clk and a switching signal generating circuit 701. As shown in FIG. 7A, the control signal EN and the internal clock Clk are inputted to the switching signal generating circuit 701, and the switching signal SC is outputted from the switching signal generating circuit 701.

According to one embodiment, the switching signal generating circuit 701 can be a logical AND circuit (e.g. AND gate), wherein the inputs of the logical AND circuit are the control signal EN and the internal clock Clk, while the output of the logical AND circuit is used as the switching signal SC. Thus, even though the time period of the high level of the control signal may be too long, the time period of the high level of the switching signal SC will not exceed the time period of the high level of the internal clock Clk.

Figure 7B:
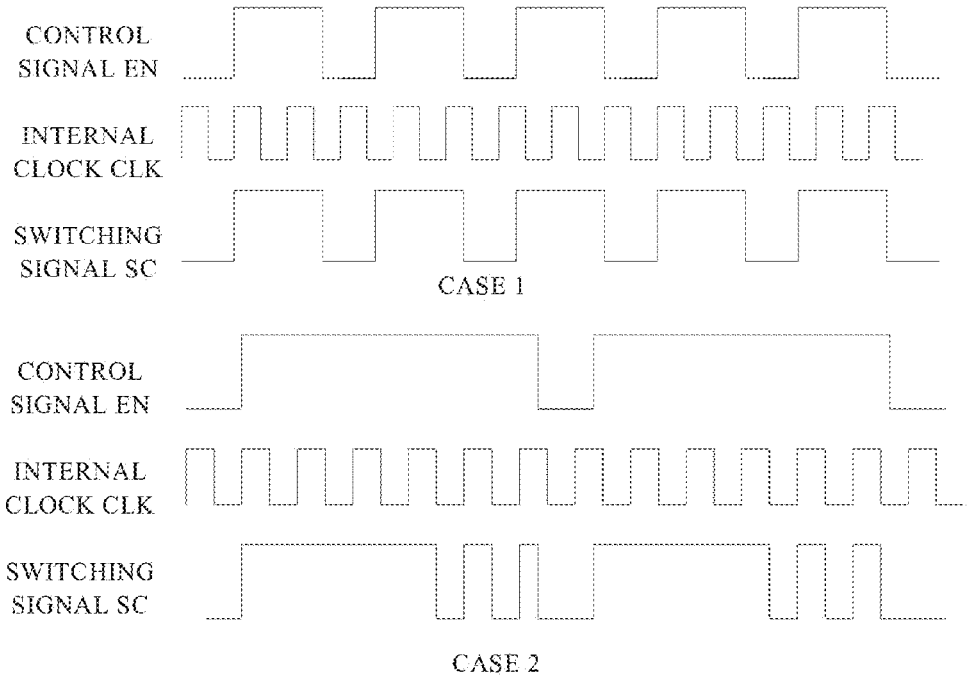
FIG. 7B shows two typical cases of input and output signal waveforms of the switching signal generating circuit, illustrating the operation mode of the switching signal generating circuit.

According to another embodiment, the switching signal generating circuit 701 is a logical circuit which can be configured as: when the control signal EN is at the first level, the switching signal SC is at the first level; and when the control signal EN is at the second level, the switching signal SC also becomes the second level, but when the duration during which the control signal EN is at the second level is larger than a threshold (e.g. three internal clock cycles), the switching signal SC will vary with the internal clock Clk. FIG. 7B illustrates the operation mode of the switching signal generating circuit 701 by means of two typical cases of input and output signal waveforms. If the high pulse width of the control signal EN is smaller than a certain number (e.g. three) of internal clock cycles, the switching signal SC will vary with the control signal EN; i.e., the waveforms become identical to the control signal EN, as shown by case 1 of FIG. 7B. If the high pulse width of the control signal EN is larger than a certain number of internal clock cycles, after the certain number of internal clock cycles are detected, the switching signal SC will vary with the internal clock Clk, and once the control signal EN becomes low, the switching signal SC will become low immediately, as shown by case 2 of FIG. 7B.

In FIG. 6A and FIG. 6B, likewise, the voltage source Voff at the non-inverting input of the error amplifier EA1 is virtual and used for the analog representation of the offset of the error amplifier EA1. That is to say, in actual situations, there is a certain offset between the voltages at the two inputs of the error amplifier EA1, and this offset is represented by Voff.

Moreover, the resistance Rpar between REFGND and BLGND is also virtual and used to simulate the parasitic resistance of wiring on the circuit board between these two ground terminals. When there is a LED current, there is an offset Iled*Rpar between the voltage Vrefgnd at REFGND and the voltage Vblgnd at BLGND.

By taking the situation in the true PWM dimming mode as an example, how the current controlling circuit 6 according to this embodiment can automatically eliminate various offsets is now described in detail. Those skilled in the art should understand that the current controlling circuit 6 according to this embodiment can also similarly automatically eliminate various offsets when dimming is not performed, or other forms of dimming is performed.

Firstly, as shown in FIG. 6A, at phase 1, the control transistor Td is OFF and there is no LED current, and thus there is no offset between the voltage Vrefgnd at REFGND and the voltage Vblgnd at BLGND. Moreover, the first switched capacitor circuit and the second switched capacitor circuit sample the reference voltage Vref and the voltage Vrefgnd at REFGND, respectively. That is, the voltage at the second terminal of the first capacitor C1 is Vref, the voltage at the first terminal of the first capacitor C1 is (Voff+Vcm), and thus the voltage Vc1 across the first capacitor C1 is equal to (Vref−Voff−Vcm). The voltage at the second terminal of the second capacitor C2 is Vrefgnd, the voltage at the first terminal of the second capacitor C2 is Vp=Vcm, and thus the voltage Vc2 across the second capacitor C2 is equal to (Vrefgnd−Vcm).

Next, as shown in FIG. 6B, at phase 2, the first switch unit S1 and the fifth switch unit S5 are OFF, the second switch unit S2 and the sixth switch unit S6 are ON, and the control transistor Td is ON. The LED current at this point is Iled, and thus there is an offset Iled*Rpar between the voltage Vblgnd at BLGND and the voltage Vrefgnd at REFGND.

Since there is no current flowing into C1 and C2 and no current flowing out of C1 and C2, the voltages Vc1 and Vc2 across C1 and C2 are kept unchanged. Therefore, at phase 2, the voltage drop across the reference resistor Rr sampled at phase 1 is transferred to the two terminals of the sensing resistor Rs. That is to say, Vref"Vrefgnd=Vres−Vblgnd, which is deduced as follows:

$$Vp = Vblgnd - Vc2 = Vblgnd - (Vrefgnd - Vcm) \rightarrow Vres = Vp + Voff + Vc1 = Vblgnd - (Vrefgnd - Vcm) + Voff + (Vref - Voff - Vcm) = Vblgnd + Vref - Vrefgnd \rightarrow Vref - Vrefgnd = Vres - Vblgnd$$

It can be seen from the above expression that the voltage drop across the sensing resistor Rs is accurately equal to the voltage across the reference resistor Rr. Accordingly, the influence of various offsets is eliminated and the LED current is accurately controlled.

With this embodiment, in addition to the advantages mentioned in the aforementioned embodiments, a further advantage is that the current controlling circuit according to the present disclosure can be seamlessly applied to the true PWM dimming LED driver, and the influence on the LED current produced by the variations of the ground voltage of the chip between the ON/OFF states of the LED current path due to board level parasitic resistance can be eliminated when the true PWM dimming is performed.

Figure 8A:
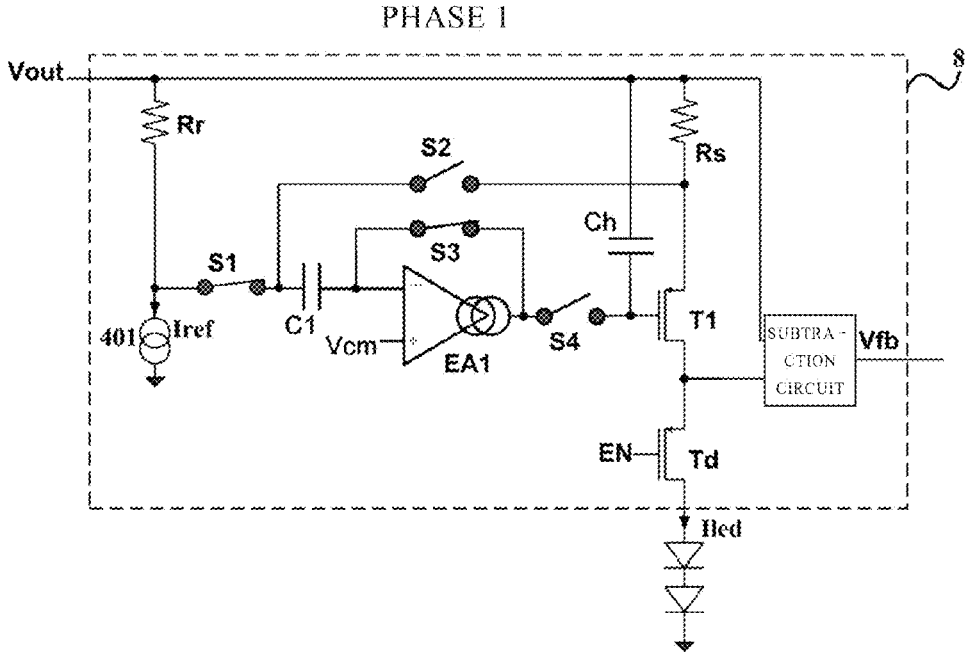
FIG. 8A and FIG. 8B show circuit diagrams of the current controlling circuit in a high side sensing mode during two phases (phase 1 and phase 2, respectively) according to one embodiment of the present invention.
Figure 8B:
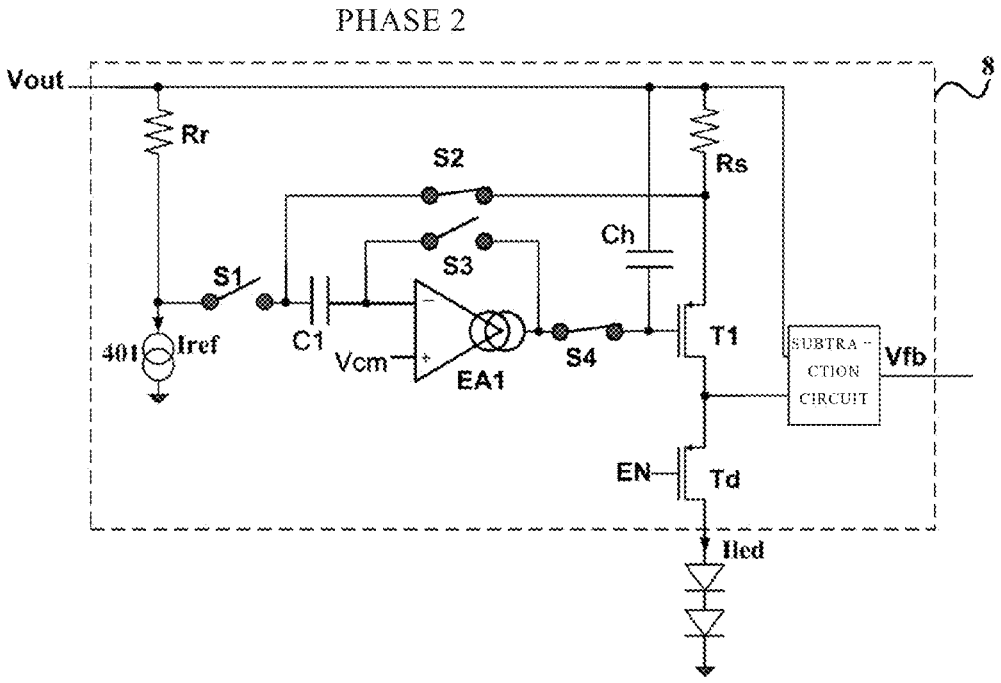

FIG. 8A and FIG. 8B show circuit diagrams of a current controlling circuit 8 in the high side sensing mode at two phases (phase 1 and phase 2) according to one embodiment of the present disclosure.

The circuit structure and operation principles of the current controlling circuit 8 according to this embodiment are similar as those of the current controlling circuit 5 as described with reference to FIG. 5A and FIG. 5B, and thus only the differences from the current controlling circuit 5 for the purpose of being adaptive to the high side sensing mode will be described below. Note that, although FIG. 8A and FIG. 8B show a control transistor Td similar to that shown in FIG. 5A and FIG. 5B, the current controlling circuit in the high side sensing mode can also have no such control transistor Td, or can have other forms of dimming circuits.

In the high side sensing mode, as shown in FIG. 8A and FIG. 8B, the output voltage Vout of the booster circuit is outputted to the current controlling circuit 8, the current controlling circuit 8 is connected to the anode of the light-emitting diode, and the cathode of the light-emitting diode is connected to ground. Specifically speaking, the output voltage Vout is connected to the second terminal of the reference resistor Rr and the second terminal of the sensing resistor Rs, and the drain of the control transistor Td is connected to the anode of the light-emitting diode.

The first transistor T1 and the control transistor Td can be PMOS transistors.

In order to make the amplitude of the feedback voltage Vfb relatively small so as to be adaptive to the subsequent boost regulator circuit that operates under a low voltage, the current controlling circuit 8 can also comprise a subtraction circuit which subtracts the drain voltage of the first transistor T1 from the output voltage Vout; accordingly, a feedback voltage Vfb having relatively small amplitude is outputted. Moreover, this feedback voltage Vfb is identical to the feedback voltage Vfb in the aforementioned low side sensing mode; that is, equivalent to the sum of the voltage drops on the sensing resistor Rs and the first transistor T1. Thus, the generation of the headroom voltage Vhr and the subsequent boost regulator circuit in the high side sensing mode can be identical to those in the low side sensing mode.

The auto zero method and principle in the high side sensing mode are identical to that in the low side sensing mode, and thus detailed description thereof will not be repeated. Likewise, the current controlling circuit in the high side sensing mode also has the aforementioned advantages.

If there is an offset between the voltage at the second terminal of the reference resistor Rr and the voltage at the second terminal (i.e. the terminal connected to the output voltage Vout) of the sensing resistor Rs in the current controlling circuit 8, another switched capacitor circuit can be added for eliminating this offset similar as shown in FIG. 6A and FIG. 6B.

Those skilled in the art can understand from the above description that the present disclosure can be implemented in various forms and the respective embodiments can be carried out independently or in combination. Thus, although the present disclosure has been described with reference to the exemplary embodiments, it should be understood that the present disclosure is not limited to the disclosed exemplary embodiments. The scope of the following claims should be given their broadest interpretations so as to include all such modifications, equivalent structures and functions.

What is claimed is:

1. A current controlling circuit, comprising:

a reference current source unit configured to generate a reference current;

a current sensing circuit comprising a reference resistor whose first terminal is connected to said reference current source unit, a sensing resistor whose resistance is in a first proportion to the resistance of said reference resistor, a first transistor whose source is connected to a first terminal of said sensing resistor, and an error amplifier; and a first switched capacitor circuit configured to sample a reference voltage at the first terminal of said reference resistor when a switching signal is at a first level and to transfer the sampled reference voltage to the first terminal of said sensing resistor when the switching signal is at a second level, such that a voltage at the first terminal of said sensing resistor is equal to a voltage at the first terminal of said reference resistor, wherein an output of said error amplifier is operable to be coupled to the gate of said first transistor through said first switched capacitor circuit, and said current controlling circuit controls a current flowing through said sensing resistor such that the current is in a second proportion to said reference current, said second proportion being a reciprocal of said first proportion.

2. The current controlling circuit of claim 1, wherein a non-inverting input of said error amplifier is connected to a common mode input voltage, and said first switched capacitor circuit comprises:

a first capacitor whose first terminal is connected to an inverting input of said error amplifier;

a first switch unit connected between the first terminal of said reference resistor and a second terminal of said first capacitor;

a second switch unit connected between the second terminal of said first capacitor and the first terminal of said sensing resistor;

a third switch unit connected between the inverting input of said error amplifier and the output of said error amplifier;

a fourth switch unit connected between the gate of said first transistor and the output of said error amplifier;

wherein the first through fourth switch units in the first switched capacitor circuit are configured such that:

when the switching signal is at the first level, the first switch unit and the third switch unit are ON, and the second switch unit and the fourth switch unit are OFF; and when the switching signal is at the second level, the first switch unit and the third switch unit are OFF, and the second switch unit and the fourth switch unit are ON.

3. The current controlling circuit of claim 1, further comprising a second switched capacitor circuit configured to sample a voltage at a second terminal of said reference resistor when the switching signal is at the first level and to transfer the sampled voltage at the second terminal of said reference resistor to a second terminal of said sensing resistor when said switching signal is at the second level, such that a voltage drop across said sensing resistor is equal to a voltage drop across said reference resistor.

4. The current controlling circuit of claim 3, wherein said second switched capacitor circuit comprises:

a second capacitor whose first terminal is connected to a non-inverting input of said error amplifier;

a fifth switch unit connected between the second terminal of said reference resistor and a second terminal of said second capacitor;

a sixth switch unit connected between the second terminal of said second capacitor and the second terminal of said sensing resistor;

a seventh switch unit connected between the non-inverting input of said error amplifier and a common mode input voltage;

wherein the fifth through seventh switch units in said second switched capacitor circuit are configured such that:

when said switching signal is at the first level, the fifth switch unit and the seventh switch unit are ON, and the sixth switch unit is OFF; and when said switching signal is at the second level, the fifth switch unit and the seventh switch unit are OFF, and the sixth switch unit is ON.

5. The current controlling circuit of claim 1, wherein said current sensing circuit further comprises a control transistor whose source is connected to a drain of said first transistor and whose gate is connected to a control signal.

6. The current controlling circuit of claim 5, wherein said control signal is a pulse width modulation signal and is used as said switching signal.

7. The current controlling circuit of claim 5, further comprising an internal clock and a logical AND circuit, wherein inputs of said logical AND circuit are connected to said control signal and said internal clock respectively, and an output of said logical AND circuit is used as said switching signal.

8. The current controlling circuit of claim 5, further comprising a switching signal generating circuit and an internal clock, wherein said switching signal generating circuit is configured such that:

said switching signal is at the first level when said control signal is at the first level; and said switching signal becomes the second level when said control signal becomes the second level, but said switching signal varies with said internal clock when the duration during which said control signal is at the second level is larger than a threshold.

9. The current controlling circuit of claim 1, wherein said current sensing circuit further comprises a holding capacitor connected between a second terminal of said sensing resistor and the gate of said first transistor.

10. The current controlling circuit of claim 1, wherein said reference current flows from the first terminal of said reference resistor to a second terminal of said reference resistor, the second terminal of said reference resistor and a second terminal of said sensing resistor are connected to ground, and said first transistor is an NMOS transistor.

11. The current controlling circuit of claim 1, wherein said reference current flows from a second terminal of said reference resistor to the first terminal of said reference resistor, the second terminal of said reference resistor and a second terminal of said sensing resistor are connected to an external voltage, and said first transistor is a PMOS transistor.

12. The current controlling circuit of claim 1, wherein said reference current source unit comprises a reference current source as well as a second transistor and a third transistor, a gate and a drain of the second transistor as well as a gate of the third transistor connected to said reference current source, a source of the second transistor is connected to a drain of the third transistor, and a source of the third transistor is connected to the first terminal of said reference resistor.

13. The current controlling circuit of claim 1, further comprising a booster circuit configured to output an output voltage larger than an input voltage;

wherein said current controlling circuit is configured to control a current flowing through one or more light-emitting diodes connected in series to a predetermined value and to output a feedback voltage and a headroom voltage to said booster circuit so as to regulate said output voltage in a negative feedback manner.

14. The driver of claim 13, wherein said current controlling circuit is connected to a cathode of the light-emitting diode and said output voltage is connected to an anode of the light-emitting diode.

15. The driver of claim 13, wherein said current controlling circuit is connected to an anode of the light-emitting diode, a cathode of the light-emitting diode is connected to ground, and said output voltage is connected to the second terminals of said sensing resistor and said reference resistor.

16. The driver of claim 13, wherein said booster circuit comprises another error amplifier;

wherein said current controlling circuit further comprises a control transistor whose source is connected to the drain of said first transistor, whose gate is connected to the control signal, and whose drain is connected to an anode or a cathode of the light-emitting diode;

wherein said reference current source unit comprises a reference current source as well as a second transistor and a third transistor, the gate and drain of the second transistor as well as the gate of the third transistor connected to said reference current source, a source of the second transistor connected to a drain of the third transistor, a source of the third transistor connected to the first terminal of said reference resistor;

wherein a voltage at the source of the second transistor is outputted to a non-inverting input of said another error amplifier as said headroom voltage, and a voltage at the drain of the first transistor is outputted to an inverting input of said another error amplifier as said feedback voltage.

17. A method for producing a current controlling circuit, comprising:

providing a reference current source unit to produce a reference current;

providing a current sensing circuit, wherein said current sensing circuit includes a reference resistor whose first terminal is connected to said reference current source unit, a sensing resistor whose resistance is in a first proportion to the resistance of said reference resistor, an error amplifier, and a first transistor whose source is connected to said sensing resistor; and providing a first switched capacitor circuit so as to sample a reference voltage at the first terminal of said reference resistor when a switching signal is at a first level, and to transfer said sampled reference voltage to a first terminal of said sensing resistor when the switching signal is at a second level, such that the voltage at the first terminal of said sensing resistor is equal to the voltage at the first terminal of said reference resistor;

wherein an output of said error amplifier is operable to be coupled to a gate of said first transistor through said first switched capacitor circuit, and a current flowing through said sensing resistor is made to be in a second proportion to said reference current by means of said current controlling circuit, said second proportion being a reciprocal of said first proportion.

18. The method of claim 17, wherein a non-inverting input of said error amplifier is connected to a common mode input voltage, and said first switched capacitor circuit comprises:

a first capacitor whose first terminal is connected to the inverting input of said error amplifier;

a first switch unit connected between the first terminal of said reference resistor and a second terminal of said first capacitor;

a second switch unit connected between the second terminal of said first capacitor and the first terminal of said sensing resistor;

a third switch unit connected between the inverting input of said error amplifier and the output of said error amplifier;

a fourth switch unit connected between the gate of said first transistor and the output of said error amplifier;

wherein the first through fourth switch units in the first switched capacitor circuit are configured such that:

when the switching signal is at the first level, the first switch unit and the third switch unit are ON, and the second switch unit and the fourth switch unit are OFF; and when the switching signal is at the second level, the first switch unit and the third switch unit are OFF, and the second switch unit and the fourth switch unit are ON.

19. The method of claim 17, further comprising providing a second switched capacitor circuit to sample a voltage at a second terminal of said reference resistor when the switching signal is at the first level and to transfer the sampled voltage at the second terminal to a second terminal of said sensing resistor when said switching signal is at the second level, such that a voltage drop across said sensing resistor is equal to a voltage drop across said reference resistor.

20. The method of claim 19, wherein said second switched capacitor circuit comprises:

a second capacitor whose first terminal is connected to the non-inverting input of said error amplifier;

a fifth switch unit connected between the second terminal of said reference resistor and the second terminal of said second capacitor;

a sixth switch unit connected between the second terminal of said second capacitor and the second terminal of said sensing resistor; and a seventh switch unit connected between the non-inverting input of said error amplifier and a common mode input voltage;

wherein the fifth through seventh switch units in said second switched capacitor circuit are configured such that:

when said switching signal is at the first level, the fifth switch unit and the seventh switch unit are ON and the sixth switch unit is OFF; and when said switching signal is at the second level, the fifth switch unit and the seventh switch unit are OFF and the sixth switch unit is ON.

21. The method of claim 17, wherein said current sensing circuit further comprises a control transistor whose source is connected to the drain of said first transistor and whose gate is connected to a control signal.

22. The method of claim 21, wherein said control signal is a pulse width modulation signal and is used as said switching signal.

23. The method of claim 21, further comprising providing an internal clock and a logical AND circuit, wherein inputs of said logical AND circuit are connected to said control signal and said internal clock, and an output of said logical AND circuit is used as said switching signal.

24. The method of claim 21, further comprising providing a switching signal generating circuit and an internal clock, wherein said switching signal generating circuit is configured such that:

said switching signal is at the first level when said control signal is at the first level; and said switching signal becomes the second level when said control signal becomes the second level, but said switching signal varies with said internal clock when the duration during which said control signal is at the second level is larger than a threshold.

25. The method of claim 17, wherein said current sensing circuit further comprises a holding capacitor connected between a second terminal of said sensing resistor and the gate of said first transistor.

26. The method of claim 17, wherein said reference current flows from the first terminal of said reference resistor to a second terminal of said reference resistor, the second terminal of said reference resistor and a second terminal of said sensing resistor are connected to ground, and said first transistor is an NMOS transistor.

27. The method of claim 17, wherein said reference current flows from a second terminal of said reference resistor to the first terminal of said reference resistor, the second terminal of said reference resistor and a second terminal of said sensing resistor are connected to an external voltage, and said first transistor is a PMOS transistor.

28. The method of claim 17, wherein said reference current source unit comprises a reference current source as well as a second transistor and a third transistor, a gate and a drain of the second transistor as well as a gate of the third transistor connected to said reference current source, the source of the second transistor is connected to the drain of the third transistor, and the source of the third transistor is connected to the first terminal of said reference resistor.

29. The method of claim 17, further comprising:

providing a booster circuit to output an output voltage larger than an input voltage; and using the current controlling circuit connected in series to control a current flowing through one or more light-emitting diodes to a predetermined value and output a feedback voltage and a headroom voltage to said booster circuit so as to regulate said output voltage in a negative feedback manner.

30. The method of claim 29, wherein said current controlling circuit is connected to a cathode of the light-emitting diode, and said output voltage is connected to an anode of the light-emitting diode.

31. The method of claim 29, wherein said current controlling circuit is connected to an anode of the light-emitting diode, a cathode of the light-emitting diode is connected to ground, and said output voltage is connected the second terminals of said reference resistor and said sensing resistor.

32. The method of claim 29, wherein said booster circuit comprises another error amplifier, wherein said current controlling circuit further comprises a control transistor whose source is connected to the drain of said first transistor, whose gate is connected to the control signal, and whose drain is connected to an anode or a cathode of the light-emitting diode;

wherein said reference current source unit comprises a reference current source as well as a second transistor and a third transistor, the gate and drain of the second transistor as well as the gate of the third transistor connected to said reference current source, a source of the second transistor connected to the drain of the third transistor, a source of the third transistor connected to the first terminal of said reference resistor; and wherein a voltage at the source of the second transistor is outputted to a non-inverting input of said another error amplifier as said headroom voltage, and a voltage at the drain of the first transistor is outputted to an inverting input of said another error amplifier as said feedback voltage.

* * * * *